United States Patent [19]

Gronebaum

[11] 4,047,359

[45] Sept. 13, 1977

[54] DEVICE FOR PACKAGING AN OBJECT IN FOIL

[75] Inventor: Theo Gronebaum, Rietberg, Germany

[73] Assignee: Firma Heinrich Kuper, Reitberg, Germany

[21] Appl. No.: 719,466

[22] Filed: Sept. 1, 1976

[51] Int. Cl.[2] ..... B65B 57/04; B65B 51/14

[52] U.S. Cl. ..... 53/64; 53/182 R; 53/389; 156/502; 156/507; 242/58.2; 242/58.4

[58] Field of Search ..... 53/64, 182, 389; 156/502, 504, 507; 242/58.1, 58.2, 58.4

[56] References Cited

U.S. PATENT DOCUMENTS

| | | | |
|---|---|---|---|
| 3,266,968 | 8/1966 | Von Gunten | 53/64 X |
| 3,490,184 | 1/1970 | Monaghan | 53/182 X |
| 3,869,844 | 3/1975 | Edouard | 53/182 X |

*Primary Examiner*—Travis S. McGehee
*Attorney, Agent, or Firm*—Herbert L. Lerner

[57] ABSTRACT

Device for packaging an object in foil wherein a pair of foils are disposed on both sides of a packaging plane and, in a central welding device, are welded to one another enclosing therebetween the object to be packaged, and wherein the foil webs travel in a given direction and, for each foil web, a foil-web parting and/or foil-web re-welding device is provided, serving to effect an exchange of foils and having functional members for parting a foil web as well as for welding a pair of juxtaposed foil-web ends together, the functional members extending transversely to the foil-web travel direction, the parting and/or re-welding device being disposed between a bearing which carries one foil roll, and a foil-web pullng device located upstream of the central welding device in the foil-web travel direction, includes at least another bearing carrying a foil roll disposed in spaced relationship to and behind the first-mentioned foil-roll bearing, means defining respective separate foil-web guide paths for the foil webs of each of the foil rolls, the guide path means having at least one conveyor device and extending from the foil-roll bearings to the vicinity of the parting and/or re-welding device, the separate guide paths having respective end regions at the vicinity of the parting and/or re-welding device, the end regions being disposed slightly spaced for one another at varying elevations.

24 Claims, 3 Drawing Figures

Figure 1:
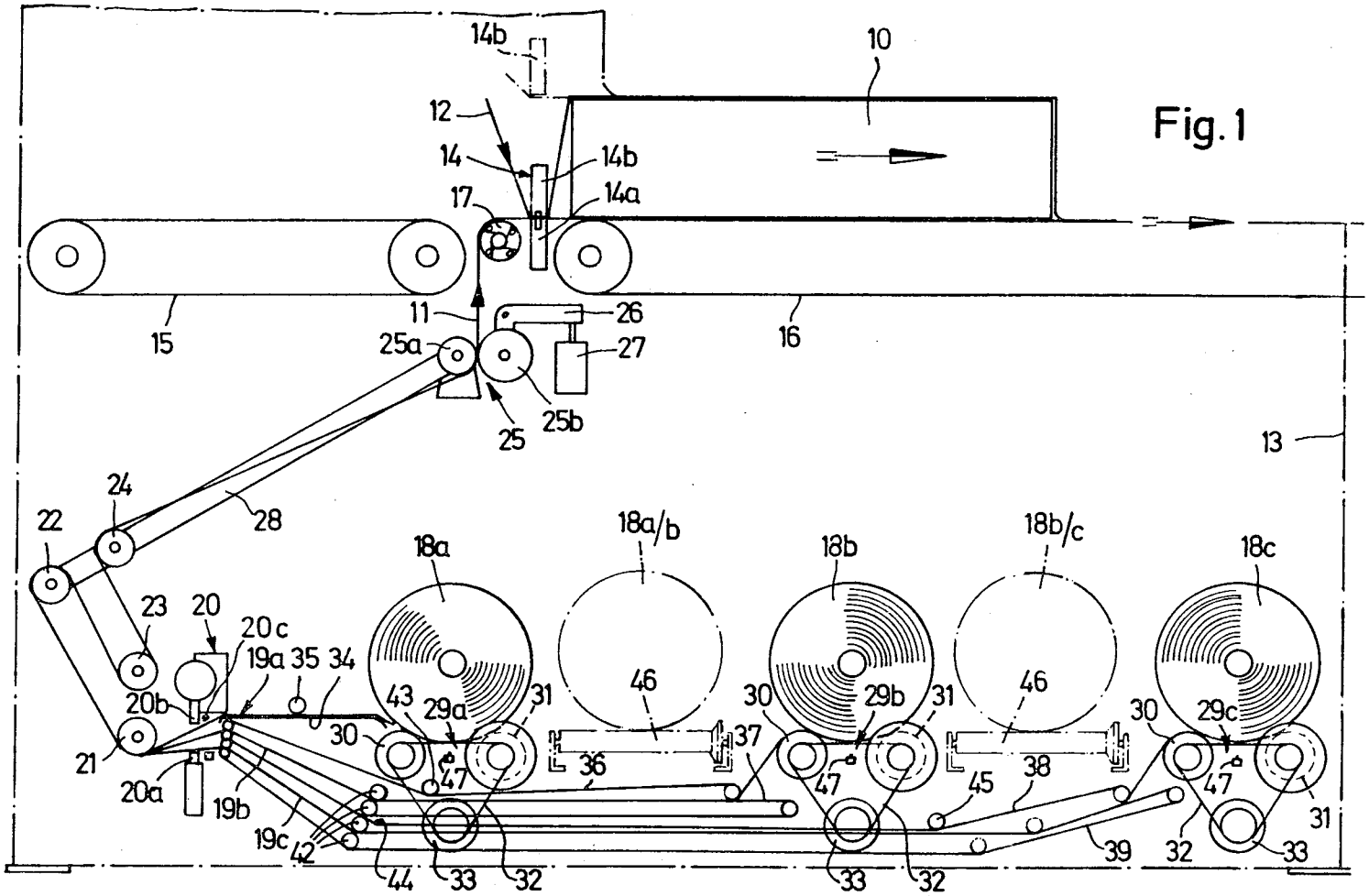

20b
35
19a
18a
34a
18a
40
18b
34
34b
30
20
18c
20a
36
42
19b
42
37
42
38
44
42
39
19c 20b
35
20
34a
18b
19a
34
18c
20a
41

42
36
19b
41
42
44
37
41
42
38
42
39
19c

DEVICE FOR PACKAGING AN OBJECT IN FOIL

The invention relates to a device for packaging objects in foil wherein at least one foil and especially two foils are disposed on both sides of a packaging plane and, in a central connecting device, such as a welding device, are connected to one another enclosing therebetween the object to be packaged and wherein the foil web travels in a given direction, and for each foil web, a foil-web parting and/or foil-web re-welding device, serving to effect a foil exchange and having functional members for parting a foil web as well as for connecting a pair of placed-together foil-web ends, the functional members extending transversely to the foil-web travel direction, is disposed between a bearing which carries one foil roll, and a foil pulling device located upstream of the central connecting device in the foil-web travel direction.

In the heretofore known packaging devices of this general type, such as are disclosed, for example, in German Published Non-Prosecuted Application DT-OS 1 931 430, the disadvantage exists that the packaging machine is inoperative for a relatively long period of time after a foil roll has been used up, because of the comparative time-consuming introduction of a new foil roll into the foil-roll bearing as well as the threading of the foil-web of the new foil roll up to the parting and/or re-welding device, which results in a considerable reduction of the hourly output of the machine and is extremely uneconomical and inefficient. It is also exceptionally disadvantageous that a time-consuming foil-roll exchange must occur in the foil-roll bearing when, for foil rolls that have not yet been used up, for example, because of other objects that are to be packaged, a different foil is required and, for that purpose, initially, the foil roll present in the foil-roll bearing for the respective foil-web side (bottom foil or top foil) is removed from the foil-roll bearing after foil-web parting has taken place, and, thereafter, the required foil roll is inserted into this foil-roll bearing. If such exchanges must frequently occur because, for example, an identical foil is required for the packaging because of the consumption of the foil previously inserted, or foils of different width, thickness and/or color are required for the packaging (which is often only for a relatively small number of objects that are to be packaged), only a relatively limited utilization or exploitation of the machine output is provided because of these troublesome "re-arming or re-preparation operations". In practice, efforts have been made to reduce the repreparation periods by means of substitute or replacement rolls provided laterally in the foil-web travel direction adjacent the foil rolls disposed in operating position, however, this has again the great disadvantage that considerably increased space for the machine assembly area is required and, because of this increased area requirement, a greater rental cost share for the packaging machine arises and, therewith having as a final effect that greater general machine costs (per unit time) result therefrom. Moreover, such an arrangement is not only costly from the construction standpoint, but also expensive and thereby uneconomical.

It is accordingly an object of the invention to provide an improved device for packaging objects by means of at least one synthetic foil which, with a relatively narrow construction that is determinable by the widest foil web that is to be used for the packaging operation, and with relatively simple assembly, affords a rapid exchange of the respective required foil webs i.e. a rapid exchange of a consumed foil roll by a new foil roll or of an actually used foil web by a foil web of different width, thickness and/or color and, therewith, increases the hourly output of the packaging machine and operates extremely efficiently.

With the foregoing and other objects in view, there is provided, in accordance with the invention, a packaging machine comprising at least two foil-roll bearings disposed behind and spaced from one another in foil-web travel direction upstream of the foil-web parting and/or re-welding device and, from the foil-roll bearings, for the foil web of each foil roll, a separate foil-web guide path furnished with conveyor parts and extending substantially to the parting and/or re-welding device, the end regions of these foil-web guide paths at the side thereof adjacent the parting and/or re-welding device (terminating) being disposed above and at a relatively slight spacing from one another. Each foil-web guide path is formed of a support member and a downholder acting thereagainst, and the outlets of all the foil-web guide paths end just upstream of the parting and/or re-welding device at respective elevations between welding jaws held apart from one another during the foil web unwinding for the packaging operation.

In accordance with another feature of the invention, the foil-web guide path for the foil web unwound from the first foil roll located closest to the parting and/or re-welding device is formed of a rigid support plate extending between a support roller, located at the withdrawal or delivery side of and forming part of the first foil-roll bearing, and the parting and/or re-welding device, and at least one roller provided thereabove, and the remaining foil-web guide paths, respectively, being formed of two revolving looping drives disposed above one another.

In accordance with a further feature of the invention, the looping drives of the second, third and more foil-web guide paths are formed, respectively, of at least one flat belt which is guided below the foil-web guide path as well as the foil-roll bearing of the preceding foil-roll or rolls and, at the side of the welding device, extending at an acute angle slung about a slender or thin diverting member, such as a rod, a member narrowing toward the parting and/or re-welding device or the like.

In accordance with an added feature of the invention, the looping drives of the second, third and more foil-web guide paths are formed, respectively, of at least one flat belt which is guided below the foil-web guide path, as well as the foil-roll bearing of the preceding foil-roll or rolls and, at the side of the welding device, is slung around a diverting roller mounted in the vicinity of and below the support roller of the first foil-roll bearing at the withdrawal or delivery side of and forming part of the first foil-roll bearing, and terminates upstream of an after-connected guide wedge narrowing in a direction toward the parting and/or re-welding device.

Further features of the invention of the instant application are presented in the remaining claims at the end of the specification herein.

As mentioned hereinbefore, the scope of the invention encompasses not only the individual features thereof but also the combination of those features.

The device of the invention is distinguished in the case of a relatively simple assembly thereof by a narrow style of construction determined by the maximal foil width and by rapid exchange of a no longer required foil roll to a subsequently required foil roll. Since a plurality of foil rolls are disposed behind one another on driven roll bearings, and separate foil-web guide paths extend from these foil-roll bearings to the vicinity of the parting and/or re-welding device, when necessary a rapid exchange is possible between the foil webs of the individual rolls as well as a rapid introduction or insertion of foils of different width, thickness and/or color; in this regard, only a parting of the foil web from the unrolling foil web end held in the vicinity of the parting and/or re-welding device to another foil roll are required.

It is also of great advantage that, with the device of the invention, when necessary, in fact a plurality of different foils can be supplied to the packaging station simultaneously as a multiple-wall (especially double-wall) packaging material. This is sensible, for example, if the material or object to be packed requires a stronger securing means at various locations i.e. is formed with sharp edges, for example, and can readily wear through a thin packaging foil. In such a case, a relatively narrow foil for solely covering the regions of special concern or hazard may be employed, together with a wider covering foil encompassing the entire packaging width, thereby, in fact, economizing on packaging material. The economy results from the fact that, on the whole, thinner packaging foil can be introduced, and the narrow auxiliary foils furnishing a retaining function of adequate quality are provided solely at the heavily stressed locations, whereas otherwise the entire packaging material would have had to be formed equally strong and wasteful of material over the entire width thereof dependent upon the highest stresses.

In accordance with another feature of the invention, the individual foil roll bearings of the lower packaging foils, including the foil rolls, are disposed beneath the conveyor device of a work table of normal table height having the packaging welding device and, accordingly good space utilization results therefrom.

The foil-roll bearings, as well as the separate foil-web guide paths for the upper packaging foil, extending from the bearings are constructed in the same sense as those for the lower packaging foil and, if necessary, in a construction that is a substantial mirror-image of the lower foil-unwindings in a row behind one another above the packaging material run-through region so that this otherwise unused space is advantageously utilized and a lower structure for the packaging machine is provided.

In accordance with a concomitant feature of the invention, the unwinding station of the upper as well as the lower packaging foils is of such construction according to the invention, that each foil-roll bearing has a pulse transmitting sensing device, such as a terminal switch or the like, which senses the end region of the respective foil roll in vicinity of a central bearing shaft extending through the foil roll or between two bearing rollers loosely carrying the foil roll thereon. This sensing device is connected to a switching device, through at least one line, which introduces an automatic foil exchange from a consumed foil roll to another foil roll bearing (when two foil-roll bearings are provided) or to a predetermined foil-roll bearing (when at least three foil-roll bearings are provided), and which controls parting of the foil roll that is being depleted, a short-stroke forward movement of the new foil to the parting and/or re-welding device as well as welding of the new foil to the end of the old foil, and further movement (unwinding) of the welded-on new foil. This switching device is connected, on the one hand, to the parting and/or re-welding device and, on the other hand, to a short-stroke drive mechanism effecting conveyance or transport of the foil web to the parting and/or re-welding device, the drive mechanism being preferably a motor-driven toothed rack drive acting upon (couplable with) a central bearing shaft extending through the foil roll or acting upon (couplable with) one of two rollers carrying the foil roll (especially the roller located at the delivery side or the side adjacent to the welding device), the switching device being connected as well to the unwinding drive for the foil-roll bearing.

The aforedescribed embodiment of the invention provides the marked advantage that in a so-called flying roll exchange, the otherwise conventional interruption of operation is eliminated, and the operator or servicing personnel does not have to intervene. This fulfills the often presented problem of effecting the most fully automatic operation of a packaging machine, and affords markedly economical advantages.

Other features which are considered as characteristic for the invention are set forth in the appended claims.

Although the invention is illustrated and described herein as embodied in a device for packaging objects in foil, it is nevertheless not intended to be limited to the details shown, since various modifications and structural changes may be made therein without departing from the spirit of the invention and within the scope and range of equivalents of the claims.

Figure 2:
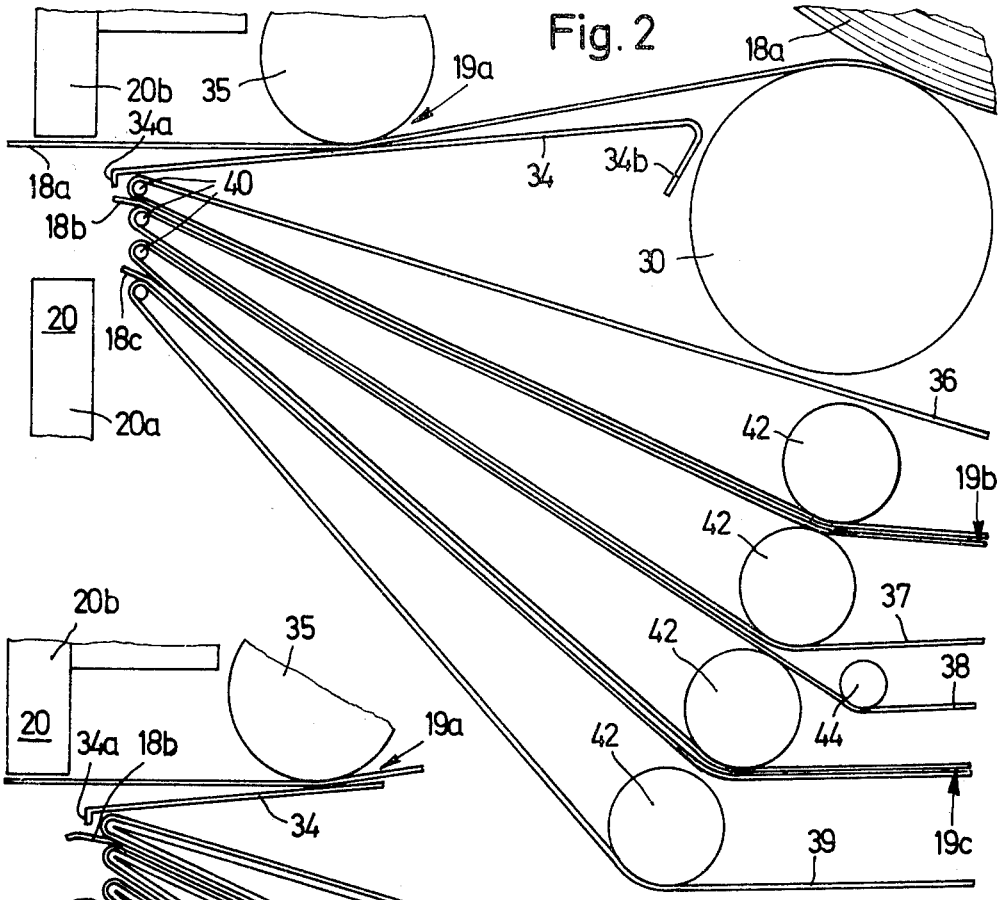
Figure 3:
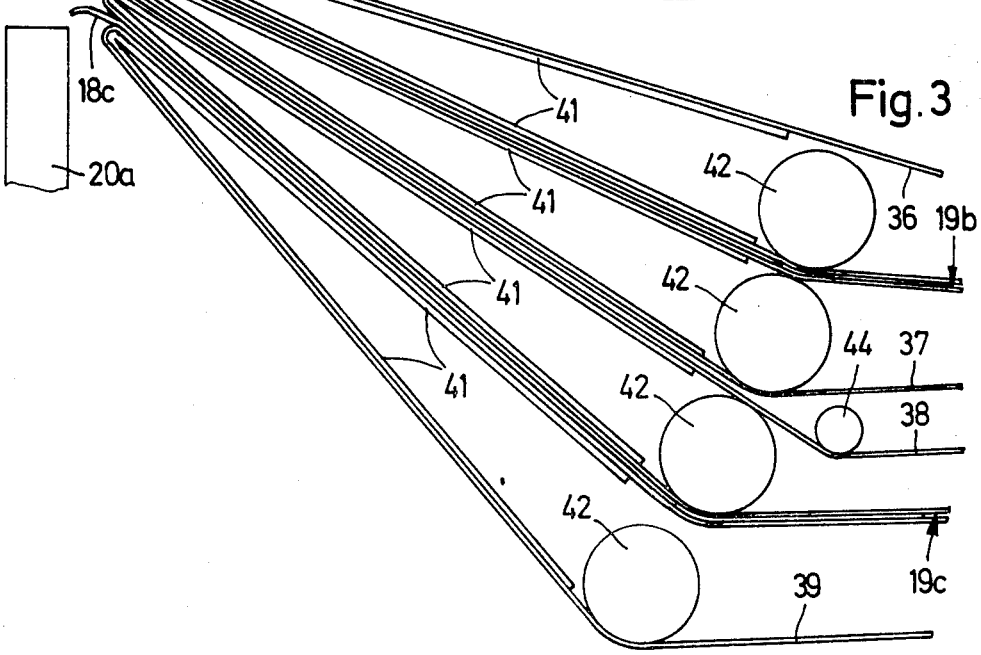

The construction and method of operation of the invention, however, together with additional objects and advantages thereof will be best understood from the following description of specific embodiments when read in connection with the accompanying drawings, in which:

FIG. 1 is a diagrammatic side-elevational view of the lower region of a device for packaging objects by means of a pair of foils, wherein a plurality of foil roll bearings are disposed serially in spaced relationship to one another forward of a separating and/or re-welding device as viewed in the travel direction of the foil web, and a separate path for the foil-web of each foil roll extends from the foil roll bearings to the vicinity of the separating and/or re-welding device;

FIG. 2 is an enlarged fragmentary view of FIG. 1 showing the end region of the foil-web guiding path at the welding device side; and FIG. 3 is a view similar to that of FIG. 2 of a modified form of the end region of the foil-web guiding path at the welding-device side.

Referring now to the drawing and first, particularly, to FIG. 1 thereof, there is shown, in accordance with the invention, a transportable device for packaging objects 10 in at least one foil (plastic or synthetic foil), and especially in a lower foil 11 and an upper foil 12. The device of the invention includes, in a framework 13 between lateral walls maintained in spaced relationship to one another, on both sides of a connecting device 14, a transporting or conveying device 15, 16 formed with a conveying surface extending substantially at the level of a work table and preferably formed of at least one looping drive respectively.

The connecting device 14 for connecting both foils 11 and 12, which are formed especially of a shrinking or contracting foil, is constructed as a welding device with welding jaws **14*a* and 14*b* disposed on above the other, as shown in FIG. 1. The lower welding jaw 14*a* is stationary and has an upper functioning surface held at the level of the plane of conveyance of both transporting or conveying devices 15 and 16, while the upper welding jaw 14*b* is disposed so as to be movable vertically and, after a welding operation has been performed, is moved upwardly into a stand-by position permitting transport or conveyance of the object 10 that is to be packaged (not the phantom view of the upper welding jaw 14*b* in FIG. 1). At least one of the two welding jaws 14*a* and 14*b* is heated. A deflecting roller 17 deflecting the foil 11 oncoming from below into an horizontal travel path and, if desired, being driven by the foil 11, is disposed between the conveyor device 15 and the lower welding jaw 14*a* of the connecting device 14. This deflecting roller 17 can serve simultaneously as a reversal or return-travel blocking device for the lower foil 11 and thereby be movable only in one travel direction. The deflecting roller 17** can furthermore also be furnished with a free-wheel or overrunning clutch.

Several (at least two and preferably three or more) foil rollers **18*a*, 18*b* and 18*c* are mounted below the conveyor devices 15 and 16, and the respective required foil webs are positively guided over respective foil-web guide paths 19*a*, 19*b* and 19*c* and others to a location just forward of a separating and/or re-welding device 20 serving the foil exchange and then through the intermediary or tautening or tight-holding members such as rollers 21 through 24, the foil web is moved by a material-pulling or drawing device 25 mounted forward of the central connecting device 14** in travel direction of the foil web.

The separating and/or re-welding device 20 is disposed with functional parts thereof extending tranversely to the foil-web travel direction and on both sides of a foil-web pass-through region, and is formed of a lower welding jaw **20*a* and an upper welding jaw 20*b*, as viewed in FIG. 1. Of these welding jaws 20*a* and 20*b*, at least one thereof is provided with a heatable functioning member (a welding bar or welding wire), and for the welding operation (for foil-web separation as well as connection of a pair of put-together web ends) at least one of both welding jaws 20*a* and 20*b* being vertically displaceable or upwardly movable. A separate vertically displaceable and preferably heated separating device 20*c* may be disposed forward of the welding jaws 20*a* and 20*b* in the foil travel direction and serves solely for separating (especially separation welding). The separating member 20*c*** can be dispensed with.

Behind the device 20, a holding device can be disposed which clampingly fixes the separated foil web and is advantageously formed of a metal counterbearing on one side of the foil and a magnet on the other side of the foil movable toward the metal counterbearing. It is preferable to provide a magnet holder, when necessary, associated with the acting against the roller 21.

The material pulling device 25 may be formed of two rollers **25*a* and 25*b* acting entrainingly with a given compressive force on both sides of the foil 11, either at least one of the rollers being driven or the deflecting roller 17, as in this case, being driven. The roller 25*a* forms a deflecting roller and the roller 25*b* is held with compressive loading or force against the opposite side of the foil 11. In a preferred manner, the roller 25*b* is mounted on a bellcrank or angle lever suspended substantially in the vertex region of the angle thereof or is connected to such a bellcrank or angle lever 26 at one leg thereof, the other leg of the bellcrank 26 extending away from the roller 25*b* being subjected to the influence of a pressure-exerting member 27, such as a pressure-medium cylinder, a weight or a spring, which effects a pivoting of the bellcrank 26 about the suspension point thereof and the exertion of the compressive force by the roller 25*b***.

Of those rollers 21 through 24 serving to tauten the foil web between the respective foil-web guiding paths **19*a* through 19*c* and the material-pulling device 25, the rollers 22 and 24 are movable and are mounted especially on a rocking lever 28 preferably limited by means of terminal switch controls disposed in the rocking path thereof. This rocking lever 28** may be spring-loaded.

All of the foil rolls **18*a*, 18*b* and 18*c* are preferably mounted in similarly constructed foil roller bearings 29*a*, 29*b* and 29*c*. Each of the foil-roller bearings 29*a* through 29*c* is made up of two support or bearing rollers 30 and 31 disposed one behind the other (with respect to the longitudinal direction of the machine and the travel direction of the foils), the bearing rollers 30 and 31 being driven by a drive motor 33 through a looping drive 32**.

Each foil-web guide path **19*a* through 19*c* is formed of a support web underlying the foil, and a down-holding member lying on the foil at the top thereof and acting against the support web. The foil-web guiding path 19*a* for the foil web withdrawn from the first foil roll 18*a* located closest to the separating and/or re-welding device 20 is formed of a rigid support plate 34 extending between the withdrawal side (the delivery side) of the bearing roller 30 of the first foil-roll bearing 29*a* and the separating and/or re-welding device 20, and at least one down-holding roller 35 provided thereabove, and the remaining foil-web guiding paths 19*b*, 19*c* are formed respectively of two revolving looping drives 36, 37 and 38, 39** disposed one above the other.

The support plate 34 is formed of a board or table-like part of sheet metal, synthetic material or the like and which is provided, at least in the end regions of the end faces thereof, with stabilizing rounded edges **34*a*, 34*b* (FIG. 2**), bends, beads or creases or the like.

In the position of the welding jaws **20*a*, and 20*b* of the separating and/or re-welding device 20, that have traveled apart during the packaging process, each outlet of the foil-web guide path 18*a* through 18*c* extends at respective elevations between the welding-device components 20*a* and 20*b* and the respective guide members end just forward of the welding station 20, as viewed in longitudinal direction (not especially FIGS. 2 and 3). The outlets (also called mouthpieces) of all the foil-web guide paths 19*a*, 19*b*, 19*c*, etc. are disposed above and slightly spaced from one another. Because the looping drives 36 through 39 terminate in vertical alignment above one another, the support plate 34 extending to the outlet-side support roller 30 of the foil-roll bearing 29*a* can project outwardly in longitudinal direction above the looping drives 36 through 39, without there being any likelihood of this support plate 34 projecting into the travel path of a foil withdrawn from the foil roll 18*b***.

In order to lower or reduce the elevation of the outlets of the individual positively guiding foil-web guide paths **19*a* through 19*c* in the vicinity of the separating and/or re-welding device 20, the individual looping drives 36 through 39 at this end are constructed so as to extend to a point and are looped around narrow rods or wires 40 (FIG. 2) and wedge-shaped members 41 (FIG. 3**).

In the embodiment of FIG. 3, each reversing or deflecting wedge 41 is formed of an acute-angled, hollow angle member, such as an angle iron or angle plate or angle-shaped metal sheet, having a rounded-off wedge point. The rounded-off wedge point prevents disadvantageous chafing or wearing of the looping bands or belts. The looping wedges 41 can also be formed of a solid mass. In a preferred embodiment of the invention, each wedge 41 extends approximately from the vicinity of the support roller 30 of the first foil-roll bearing 29*a*, at the welding-device side, to the looping drive ends near the separating and/or re-welding device 20. Each deflecting or reversing wedge 41 borders supportingly on the respective looping drive 36 through 39 and has a smooth surface. To minimize the friction between the looping means and the wedges 41, the latter may be formed of a material having a low coefficient of friction, or may be provided, in the region of the functional surfaces thereof, with a friction-minimizing layer or coating, for example a silicon material, polytetrafluorethylene (PTFE-synthetic material), or the like.

The individual looping-drive pairs 36/37 and 38/39 for the respective foil web 18*b* and 18*c* are disposed above and slightly spaced from one another so that the individual looping-drive pairs do not interfere with one another, both looping drives 36 and 37, on the one hand, and 38 and 39, on the other hand being merely coupled functionally to one another and thus held against one another so that entrainment and further guidance of the intermediately disposed foil web is possible if required.

Each foil-web guide path 19*a,* 19*b* and 19*c* is provided with a conveyor part. Whereas this conveyor part is formed by the downholder roller 35 with respect to the foil-web guide path 19*a,* at least one of both of the looping drives can be driven in the cases of the remaining foil-web guide paths 19*b,* 19*c* and others.

The looping drives 36 through 39 are advantageously formed of thin, flat belts, such as textile belts especially. The width of these belts is about 80 to 160 mm, preferably 120mm; however, wider or narrower textile belts may also be used. In order to guide even wider foil webs without any difficulty, a plurality of flat belts are disposed on the same parts about which they are reversed or looped.

The foil-web guide path for each foil roll 18*b,* 18*c* etc. mounted a farther distance from the separating and/or re-welding device 20 is disposed below the preceding foil-web guide path or paths and, if necessary, diverted by respective diverting or deflecting members such as rollers 43 through 45 so that no collision of the individual looping drive of the one foil-web guide path with that of another foil-web guide path or with parts of a foil-roll bearing is possible.

Between two foil-roll bearings 18*a* and 18*b,* on the one hand, 18*b* and 18*c,* on another hand, (and insofar as additional foil-roll bearings may be provided, then 18*c* and 18*d,* on the third hand, etc.) a transversely extending foil-roll supply device 46 is respectively disposed, a replacement roll being introducible thereby into the device transversely to the travel direction of the foil web. This foil-roll supply device 46 is preferably formed of a conveyor, such as a conveyor belt, roller walks or paths or the like that are movable or revolvingly driven in direction of the longitudinal axes of the foil rolls. In a preferred manner, the foil-roll supply device 46 is formed of a plurality of conveyor rollers disposed adjacent to and spaced from one another.

The hereinaforedescribed lower unwinding stations for the lower foil 11 can be provided in the same sense also for the upper foil 12, as viewed in FIG. 1.

The individual foil rolls 18*a* and 18*c* can have foils of different widths and/or thicknesses as well of different colors, if necessary.

In an advantageous manner, each motor-driven foil-roll bearing 29*a* to 29*c* is furnished with an engageable and disengageable manual drive permitting manual foil-web threading through the respective foil-web guide path 19*a* to 19*c,* such as with a central bearing shaft passing through the foil rolls 18*a* to 18*c* or a manual starting crank couplable to a foil-roll support roller 30. The hereinaformentioned central bearing shaft or the support roller 30 can be provided with an overrunning or freewheel clutch.

In order to notify the operator or servicing personnel of the approaching end of the respective foil roll 18*a* to 18*c* being used, conventional sensing devices, such as electric limit switches, pneumatic sensors or the like, which sense the end region of a foil-roll and transmit a pulse, are provided in the vicinity of a central bearing shaft passing through the foil rolls 18*a* to 18*c* or between two bearing rollers 30 and 31 carrying foil rolls 18*a* to 18*c* loosely lying thereon.

The pulse transmitted by the sensing device 47 can serve to switch on an optical and/or acoustic signaling device which is located directly at the packaging machine and/or located at a very great distance therefrom at a suitable location.

The pulse from the sensing device 47 of each foil-roll bearing 29*a* to 19*c* can, however, also be used as a releasing or activating pulse for automatically replacing a consumed foil roll by another full foil roll. Such an automatic foil exchange or replacement is possible only between two foil-roll bearings; as long as more than two foil-roll bearings 29*a* to 29*c* are provided, respectively, for each packaging foil 11, 12 in the packaging machine according to the invention of the instant application, then at a suitable instant, for example when a foil-roll bearing is filled with a new foil roll, respectively, a choice is to be made as to which foil roll should be used after the respective unwinding foil roll 18*a* to 18*c* has been consumed.

In order to be able to effect the automatic foil exchange or replacement between two foil rolls 18*a* and 18*b,* the sensing device 47 provided, respectively, in vicinity of a foil roll located in a roll-off bearing is connected to a central switching device through a suitable electric line or lines or a suitable pneumatic line or lines. From the various foil-roll bearings 29*a* to 29*c* (and in the event additional foil-roll bearings are provided, then also 29*d* and others, if necessary a functional pair or duo is thus able to be interconnected.

The switching device energizable by a releasing or actuating pulse from the sensing device 47 is connected through respective lines (electric lines and/or pneumatic lines), on the one hand, to the separating and/or re-welding device 20 and, on the other hand, to a short-stroke drive device effecting the conveyance of the foil web to the separating and/or re-welding device 20, the drive device being preferably a motor driven toothed rack drive acting upon (couplable with) a central bearing shaft passing through the foil rolls 18*a* to 18*c* or acting upon one of the two rollers 30 and 31 carrying the foil rolls, and especially the support roller 30 at the withdrawal or delivery side (the welding-device side), as well as the roll-off drive 32/33 of the foil roll-bearing 29*a* to 29*b.*

With such an embodiment of the invention, manual intervention by an operator or servicing personnel during rapid exchange of foil rolls (empty as against full) can be done away with entirely and a so-called "flying roll exchange" is possible. The signal transmitter formed by the sensing device 47 signals the end of the virtually empty foil roll and introduces the automatically starting exchange process to the neighboring station equipped with a full roll (with the use of at least three foil-roll bearings 29*a* to 29*c* to the foil roll predetermined for the exchange operation). Initially, after a respective packaging cycle, the drive of foil roll 18*a* to 18*c* being unwound until then is stopped, then separation welding is effected with the device 20 and, simultaneously or immediately after the separation welding, the short-stroke auxiliary drive of the foil roll 18*a* to 18*c* to be unwound thereafter is switched on so that the starting end of the foil roll being introduced is moved through the respective foil-web guide path 19*a* to 19*c* to the separating and/or re-welding device 20 and can be welded thereat to the terminating end of the preceding or old foil web. After the resulting welding of the new foil web, the roll-off drive of the foil-roll bearing carrying the new and full foil roll is then switched on and the packaging function of the machine is resumed.

This automatic foil-roll exchange occurs, on the one hand, extremely rapidly and thereby assures good utilization of the machine performance or output and, moreover, reduces personnel expenses since the operators or servicing personnel do not have to intervene for the foil-roll exchange and can thereby simultaneously supervise or control more packaging machines than were heretofore possible.

There is claimed:

1. Device for packaging an object in foil wherein a pair of foils are disposed on both sides of a packaging plane and, in a central welding device, are welded to one another enclosing therebetween the object to be packaged, and wherein the foil webs travel in a given direction and, for each foil web, a foil-web parting and-/or foil-web re-welding device is provided, serving to effect an exchange of foils and having functional members for parting a foil web as well as for welding a pair of juxtaposed foil-web ends together, the functional members extending transversely to the foil-web travel direction, the parting and/or re-welding device being disposed between a bearing which carries one foil roll, and a foil-web pulling device located upstream of the central welding device in the foil-web travel direction, the packaging device comprising at least another bearing carrying a foil roll disposed in spaced relationship to and behind the first-mentioned foil-roll bearing, means defining respective separate foil-web guide paths for the foil webs of each of the foil rolls, said guide path means comprising at least one conveyor device and extending from said foil-roll bearings to the vicinity of said parting and/or re-welding device, said separate guide paths having respective end regions at said vicinity of said parting and/or re-welding device, said end regions being disposed slightly spaced from one another at varying elevations.

2. Packaging device according to claim 1 including a device for supplying foil rolls to said foil-roll bearing.

3. Packaging device according to claim 1 wherein said parting and/or re-welding device comprises a pair of welding jaws disposed vertically spaced from one another during unwinding of the foil webs, and wherein said means defining respective separate foil-web guide paths comprise members having supporting surfaces and respective down-holding members acting against said supporting surfaces, said guide paths having outlets terminating just before said parting and/or re-welding device in travel direction of the foil webs at respective different elevations between said spaced welding jaws.

4. Packaging device according to claim 3 wherein said means defining the guide path for the foil web unwound from a first foil roll carried by a first bearing located closest to said parting are/or re-welding device is formed of a rigid support plate extending from a location adjacent a support roller disposed at the delivery side of and forming part of said first bearing to a location adjacent said parting and/or re-welding device, and at least one down-holding roller disposed above said support plate, and said means defining the guide path for foil webs unwound from foil rolls carried by respective bearings more distant than said first bearing from said parting and/or re-welding device comprising at least two revolving looping drives disposed one above the other.

5. Packaging device according to claim 4 wherein said support plate is formed of a table top-like part having stabilizing means, at least in the end regions of the end faces thereof.

6. Packaging device according to claim 5 wherein said support plate is formed of material selected from the group consisting of sheetmetal and synthetic material.

7. Packaging device according to claim 5 wherein said stabilizing means is selected from the group consisting of rounded edges, bends, beads and creases.

8. Packaging device according to claim 4 wherein said looping drives are formed, respectively, of at least one flat belt guided below the respective foil-web guide path as well as below the foil-roll bearing of the preceding foil roll, and including a narrow diverting member adjacent said parting and/or re-welding device, said flat belt extending at an acute angle slung about said diverting member.

9. Packaging device according to claim 8 wherein said narrow diverting member is a rod.

10. Packaging device according to claim 8 wherein said narrow diverting member is a wedge-shaped member narrowing in direction toward said parting and/or re-welding device.

11. Packaging device according to claim 4 wherein said looping drives are formed, respectively, of at least one flat belt guided belwo the respective foil-web guide path as well as below the foil-roll bearing of the preceding foil roll and, adjacent said parting and/or re-welding device, is slung around a diverting roller mounted in vicinity of and below the support roller of said first foil-roll bearing at the delivery side of and forming part of said first foil-roll bearing, said flat belt terminating upstream of an after-connected guide wedge narrowing in direction toward said parting and/or re-welding device.

12. Packaging device according to claim 11 wherein said guide wedge is formed of a hollow angle member having rounded wedge points, said guide wedge having functional surfaces with a relatively low coefficient of function.

13. Packaging device according to claim 12 wherein said functional surfaces are formed on a friction-minimizing layer of material selected from the group consisting of silicon and polytetrafluorethylene.

14. Packaging device according to claim 13 including a foil-roll supply device extending transversely to the foil-web travel direction receivable between two of said foil-roll bearings, respectively.

15. Packaging device according to claim 14 wherein an object is enclosed between upper and lower packaging foils, and including a working table of conventional table height, said working table carrying the central welding device and comprising conveyer means for an object being packaged, individual foil roll bearings for the lower packaging foils, including the foil rolls carried thereby, being disposed beneath said conveyer means of said working table.

16. Packaging device according to claim 15 wherein said foil-roll bearings are motor driven and are provided with an engageable and disengageable manual drive for manually threading a foil web through the respective foil-web guide path.

17. Packaging device according to claim 16 wherein said manual drive comprises a central bearing shaft extending through a respective foil roll.

18. Packaging device according to claim 16 wherein said manual drive comprises a manual crank couplable with a respective foil-roll support roller.

19. Packaging device according to claim 16 including a pulse transmitting sensing device adjacent the respective foil-roll bearings for sensing the end region of the respective foil roll, and a signal indicating device connected to said pulse transmitting sensing device.

20. Packaging device according to claim 19 wherein said sensing device is disposed in vicinity of said central bearing shaft extending through the respective foil roll.

21. Packaging device according to claim 19 wherein said sensing device is disposed between two rollers of a respective bearing whereon the respective foil roll is loosely supported.

22. Packaging device according to claim 19 including a switching device connected to said pulse transmitting sensing device, said switching device having means for introducing an automatic foil exchange from a depleted foil roll to a predetermined foil-roll bearing, means for controlling said parting and/or re-welding device to part the foil roll being depleted, means for imparting a short-stroke forward movement of the new foil to said parting and/or re-welding device and for welding the new foil to the parted end of the old foil, and means for further unwinding the welded-on new foil, said switching device being connected on the one hand, to said parting and/or re-welding device and, on the other hand, to a short-stroke drive mechanism for effecting conveyance of the foil web to said parting and/or re-welding device, and being connected as well to the unwinding drive for the respective foil-roll bearing.

23. Packaging device according to claim 22 wherein said short-stroke drive mechanism comprises a motor-driven toothed rack drive acting upon the central bearing shaft extending through the respective foil roll.

24. Packaging device according to claim 22 wherein said short-stroke drive mechanism comprises a motor-driven toothed rack drive couplable with one of the two rollers of the respective foil-roll bearing.

* * * * *